US005154029A

United States Patent [19]

Sturgeon

[11] Patent Number: 5,154,029

[45] Date of Patent: Oct. 13, 1992

[54] SELF-DRAINING BUILDING PANEL SYSTEM

[75] Inventor: Micheal E. Sturgeon, Ontario, Canada

[73] Assignee: Canadian Rain Screen Technologies, Ltd., Downsview, Canada

[21] Appl. No.: 643,441

[22] Filed: Jan. 18, 1991

[51] Int. Cl.[5] ..... E04H 1/06

[52] U.S. Cl. ..... 52/235; 52/61; 52/95; 52/823

[58] Field of Search ..... 52/235, 302, 304, 60, 52/62, 58, 61, 94, 96, 209, 368, 372, 732, 735, 823, 824, 165.9

[56] References Cited

U.S. PATENT DOCUMENTS

| | | | |
|---|---|---|---|
| 1,518,582 | 12/1924 | Himmel et al. | 52/209 |
| 3,332,197 | 7/1967 | Hinkle | 52/732 X |
| 3,867,799 | 2/1975 | Pryor et al. | 52/235 |
| 4,819,405 | 4/1989 | Jackson | 52/235 X |
| 4,999,960 | 3/1991 | Herwegh et al. | 52/235 |

FOREIGN PATENT DOCUMENTS

| | | | |
|---|---|---|---|
| 2924108 | 6/1980 | Fed. Rep. of Germany | 52/235 |
| 1404675 | 3/1973 | United Kingdom | 52/235 |

*Primary Examiner*—David A. Scherbel
*Assistant Examiner*—Kien Nguyen
*Attorney, Agent, or Firm*—Volpe and Koenig

[57] ABSTRACT

A building panel having a vertical face portion and integral upper and lower horizontal portions, together defining a U-shape, is disclosed. The building panel is intended for installation on the vertical face of a building adjacent another building panel or other building element, with sealant between the upper portion and the other building panel or other building element at a seal location near the face portion, and with the upper and lower portions directed towards the face of the building. The upper portion has a downwardly-directed channel defined therein, running generally parallel to the face panel behind the seal location, to collect moisture. The channel has at least one drain hole in the bottom thereof. The moisture drops through the drain holes onto the lower portion, and drains away from the building from there. The building panel system includes a complementary U-shaped positioning element having a vertical mounting surface and integral upper and lower horizontal positioning surfaces. The mounting surface is intended to be fastened to the face of the building with the upper and lower positioning surfaces projecting outwardly therefrom. The upper and lower portions of the building panel are fastened to the upper and lower positioning surfaces respectively. Spacers acting also as drains space the lower portion of the building panel slightly above the lower positioning surface of the positioning element, and moisture drains out via that route.

7 Claims, 7 Drawing Sheets

SELF-DRAINING BUILDING PANEL SYSTEM

BACKGROUND OF THE INVENTION

1. Field of the invention

This invention relates generally to exterior panel systems for use in high rise and low rise building construction, and particularly to a self-draining face mount system which is integrated with a building's window system to provide superior protection against moisture penetration, condensation and related water damage.

2. Description of the Prior Art

Generally modern day buildings, and particularly high rise construction, is accomplished using poured concrete flooring slabs which are interspaced vertically and supported by means of a steel beam and concrete framework. The exterior of the buildings is usually comprised of a combination of solid facing material and a window system which together form the external wall structure.

Window systems are placed between the concrete flooring slabs using a variety of installation techniques. Many of these techniques involve covering the end of the flooring slab and any internal wall structure with some type of weather resistant panel, securing the window in place and then sealing any resulting joints with a weather resistant sealant such as exterior caulking to prevent moisture entry and the resultant damage typically caused thereby.

All exterior grade weather resistant sealants currently employed breakdown over time due to curing and drying out of the compound itself, due to stress related to building deflection and movement, and also due to exposure to the elements including exposure to ultra violet radiation. This breakdown causes the sealant to lose its effectiveness in preventing moisture entry into the interior of the wall system or further into the interior of the building.

One present attempt to solve the problem is to remove the sealant once it has broken down and replace it with new material. This requires substantial time and expense and damage can still result if this procedure is not performed on a timely basis.

Other methods involve modifications to the physical design of a panel system or window system in an attempt to prevent moisture that does penetrate the sealant from entering the interior wall system. These methods typically employ designs that minimize the number of joints that must be sealed. For example, one solution provides windows with frames that are enlarged so as to cover the end of an adjacent flooring slab, and which continue until they meet the frame of an adjacent window. This design reduces the number of joints between adjacent windows from two to one.

Another problem with the existing efforts is that the metal panels used to cover the end of the flooring slab and any internal wall structure have typically been made and fastened to a building structure in a way which allows outdoor temperatures to be conveyed to the interior of the wall system, thereby creating an area at which condensation can form, damaging the adjacent interior room finish.

To date none of the attempted solutions has been entirely satisfactory in preventing moisture penetration to the interior wall system once the sealant has broken down.

SUMMARY OF THE INVENTION

It is an object of the present invention to provide a panel system for exterior use in building construction that will substantially prevent moisture penetration and the consequent damage caused thereby if the exterior weather sealant ultimately breaks down.

It is a further object of the invention to provide a complete and flexible panel system that is capable of being adapted to a wide variety of building styles and installations requiring special applications.

It is a further object of the invention to provide a system that is simple to install and that is essentially maintenance-free.

It is a further object of the invention to provide a panel system which will not convey outdoor temperatures to the interior of a building thereby avoiding the problems caused by condensation damage.

In the invention, there is a building panel having a vertical face portion and integral upper and lower horizontal portions, together defining a U-shape. The building panel is intended for installation on the vertical face of a building adjacent another building panel or other building element, with sealing means between the upper portion and the other building panel or other building element at a seal location near the face portion, and with the upper and lower portions directed towards the face of the building. The upper portion has a downwardly-directed channel defined therein, running generally parallel to the face panel behind the seal location, to collect moisture. The channel has at least one drain hole in the bottom thereof. The moisture drops through the drain holes onto the lower portion, and drains away from the building from there.

The building panel system includes a complementary U-shaped positioning element having vertical mounting surface and integral upper and lower horizontal positioning surfaces. The mounting surface is intended to be fastened to the face of the building with the upper and lower positioning surfaces projecting outwardly therefrom. The upper and lower portions of the building panel are fastened to the upper and lower positioning surfaces respectively.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
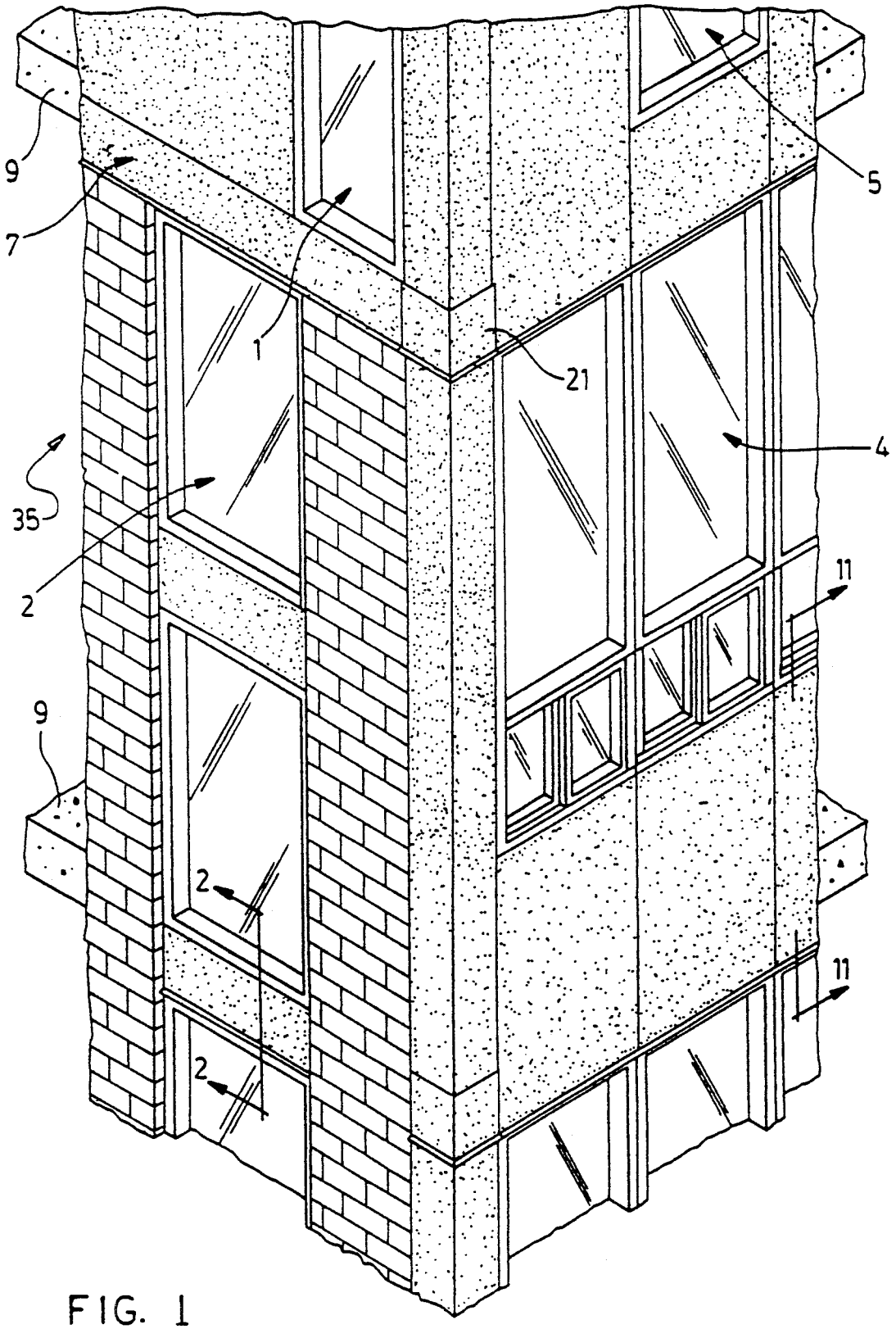
FIG. 1 is perspective view of the exterior of a building depicting a variety of installed window systems.

FIG. 1 shows installations of floor to ceiling windows 1, smaller windows 2 which have their lower edge abutting the concrete flooring slab 3, and windows 4 and 5 which are vertically positioned part way between the flooring slabs of adjacent floors in the building. These are some of the applications for which the panel system disclosed in the present invention has been designed.

Figure 2:
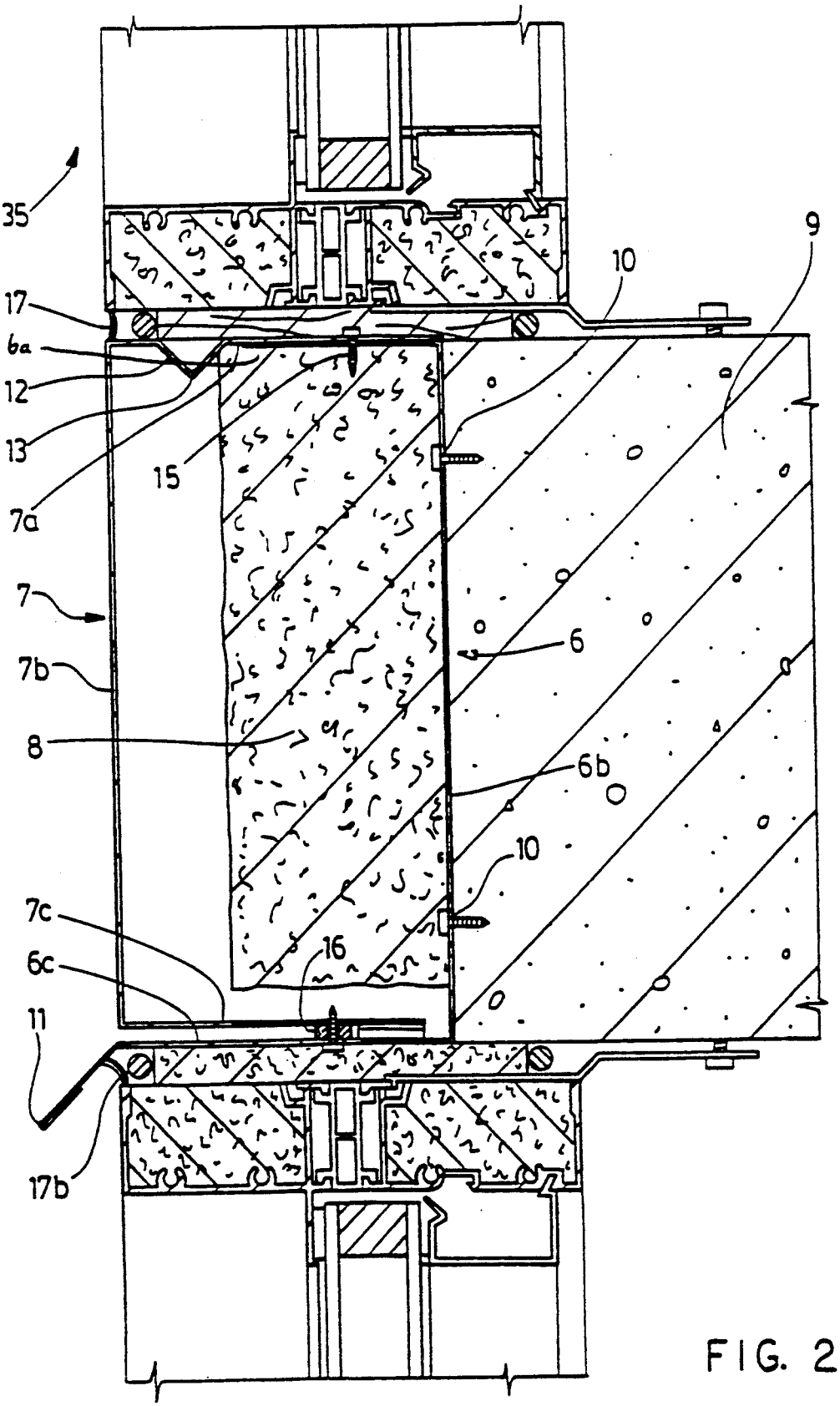
FIG. 2 is side elevational sectional view of the panel system at line 2—2 of FIG. 1.
Figure 3:
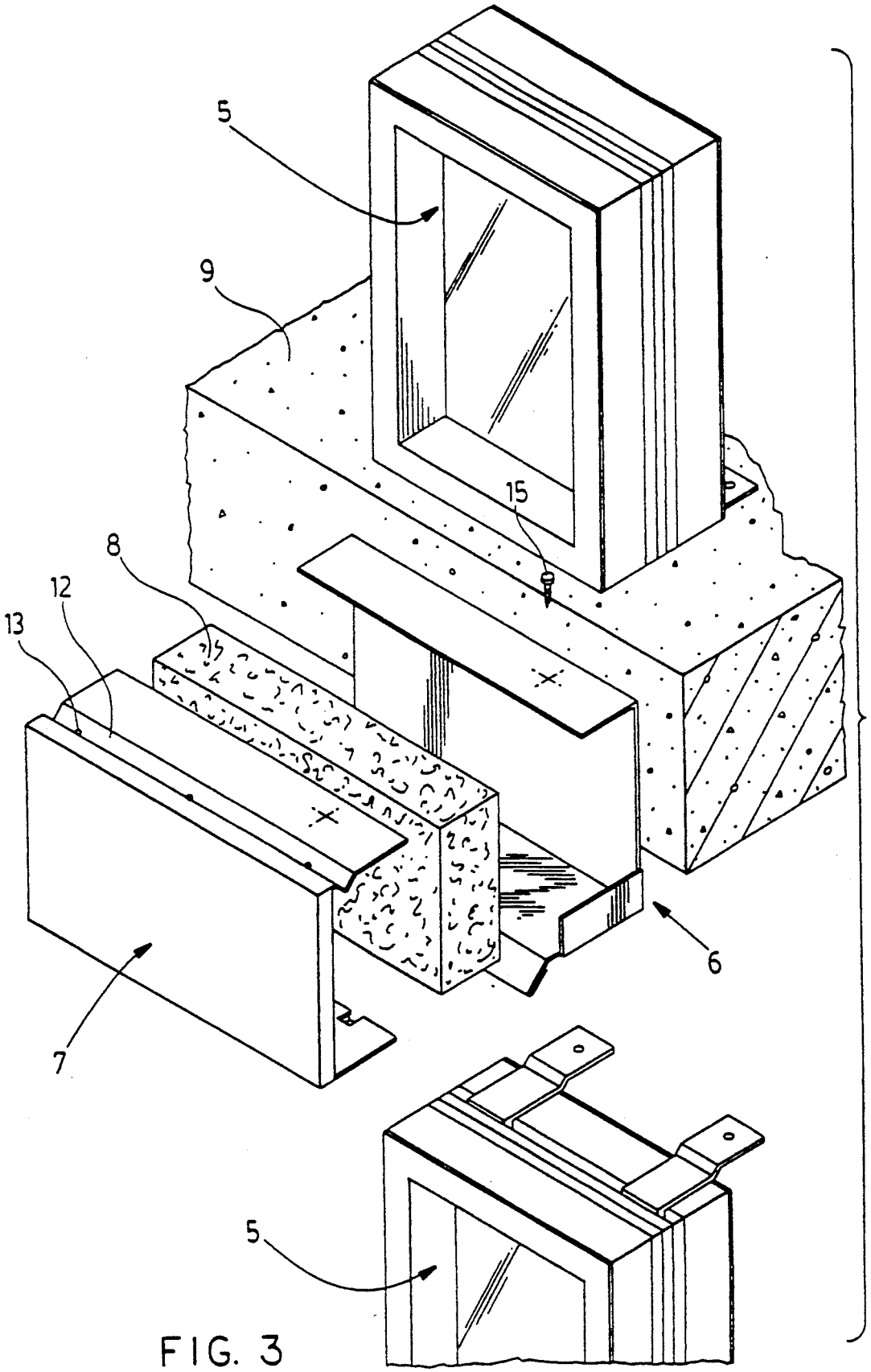
FIG. 3 is an exploded perspective view corresponding to FIG. 2, illustrating the shape of the two main panels that comprise an embodiment of the present invention.

Referring to FIG. 2, the main components of the preferred embodiment of the present invention are shown, namely, the inner panel 6, the outer panel 7, with thermal insulation 8 being positioned therebetween. The inner panel is mechanically fastened to the vertical end of the flooring slab 9 at points 10. The method of fastening is typically by means of explosive actuated pins, Tapcon (trademark) screws or screws being received into expandable wall plugs. Other suitable means of fastening the panels may be employed, such suitable means being generally determined by the substructure into which the fasteners are to be received.

The inner panel 6 is comprised of one continuous generally U-shaped piece of material being comprised of four integral separate sections, namely a vertical section 6*b*, upper and lower horizontal sections 6*a* and 6*c* which are perpendicular to the vertical section and which project outwardly from it, and a drip edge 11 extending from the lower horizontal section. The inner panel 6 is typically fastened to the edge of the flooring slab 9 through the vertical section 6*b*. The horizontal length of the vertical section 6*b* is determined by the width of the flooring slab 9 or flooring slab and wall combination for which it is intended to cover. The drip edge 11 is extended and angled outwardly and downwardly at approximately 40–45 degrees from the vertical and meets the lower horizontal section 6*c* at a point approximately in the vertical plane described by the exterior face of the building. The drip edge 11 can be designed to project to whatever extent and at whatever angle is most desirable taking into consideration the exposure parameters existing at any specific installation site and aesthetic considerations if desired. The drip edge 11 could also be constructed as part of the outer panel 5 to augment or possibly replace the drip edge 11 typically incorporated as part of the inner panel 6.

The second main component of the panel system is the outer panel 7. The outer panel 7 is also one continuous generally U-shaped piece of material consisting again of upper and lower horizontal sections 7*a* and 7*c* being perpendicular to a vertical section 7*b*. When fastened the upper and lower horizontal sections 7*a* and 7*c* typically project inwardly from the vertical section 7*b*. The upper horizontal section 7*a* contains a drainage groove or channel 12 which in this embodiment of invention is V-shaped and is approximately three quarters of one inch deep, three quarters of one inch wide at the top, and which is set back approximately three quarters of one inch from the edge of the vertical section 7*b*. Along the centre of the groove 12 are a plurality of evenly spaced circular drainage holes 13. The shape, dimensions and positioning of the drainage groove 12 and drainage holes 13 is variable and dependent on specific applications.

The preferred material for both the inner and outer panels is a suitable type of metal panel, typically being prefinished galvanized steel or aluminium. Other metals with aesthetic qualities such as brass may also be employed. The gauge, overall width, height, and other dimensions and properties of any specific panel will vary with the application. Similarly, the type, thickness and size of the thermal insulation 8 will vary as will the type of fasteners employed, the size, location and style of hat spacers and related weep slots, and certain aspects of the internal construction of the panel system such as stiffeners and bracing for larger installations.

The inner panel 6 is installed to the face of a concrete flooring slab 9 or slab and exterior wall section combination, and fastened as previously described. No part of the panel system described in the present invention extends inwardly past the exterior face of the flooring slab or exterior wall. Present solutions and fastening means often involve a metal panel being wrapped around the end of the flooring slab and fastened so that the metal panel extends inwardly along the top and bottom surface of the flooring slab. Typically the panel extends inwardly to a point adjacent to an interior room area. If the metal panel is cooled from the outside air condensation often occurs where the cold metal panel is in contact with heated interior air. This usually occurs under the interior ceiling in the area near the top of exterior windows and often causes discolouration and related condensation damage.

The upper horizontal section 7*a* of the outer panel 7 is installed over the upper horizontal section 6*a* of the inner panel 6 so that the vertical section of the outer panel 7*b* is in the same vertical plane as the exterior face of the building 35. The two panels are mechanically fastened to each other at 14 using any suitable means, typically being corrosion-resistant self tapping screws.

The lower horizontal section 7*c* of the outer panel 7 is installed above the lower horizontal section 6*c* of the inner panel 6 using a mechanical fastener 15, again typically a self-tapping screw, being installed through a gasket 16 made of a suitable water-resistant material such as neoprene.

Figure 6:
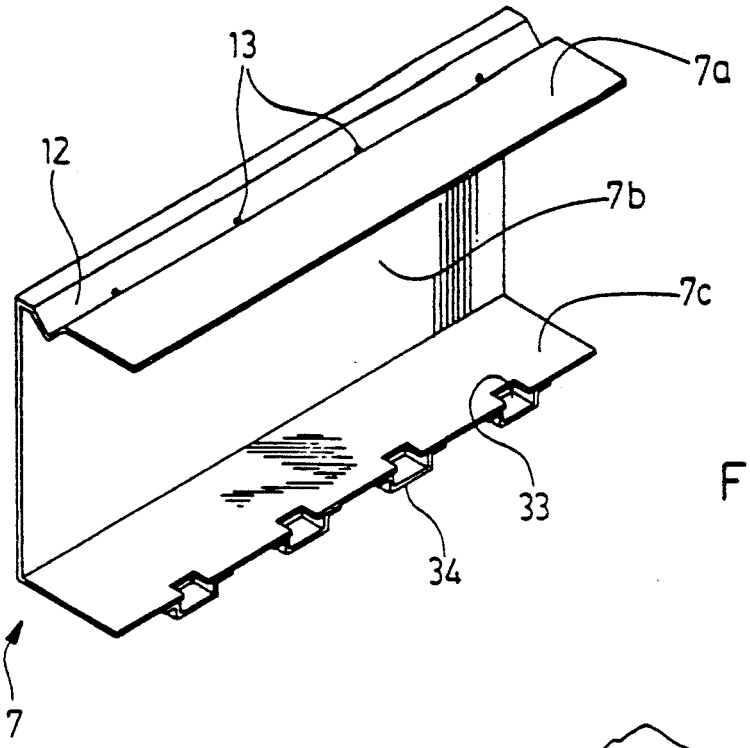
FIG. 6 is a perspective view of the outer panel.
Figure 7:
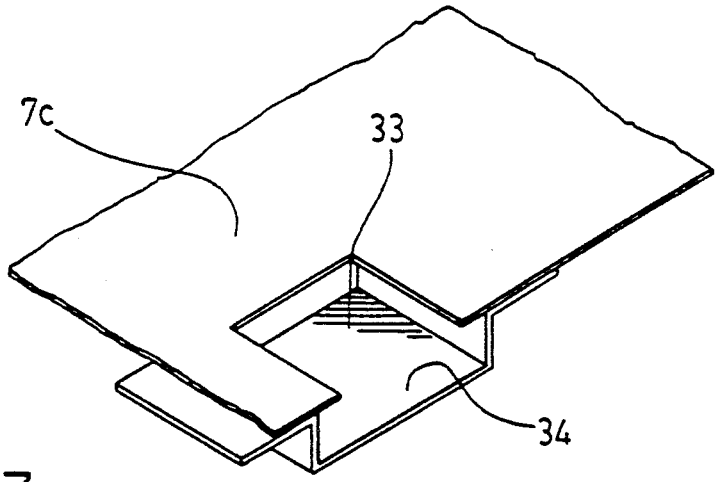
FIG. 7 is a perspective view of a spacer illustrating the flow through design.
Figure 8:
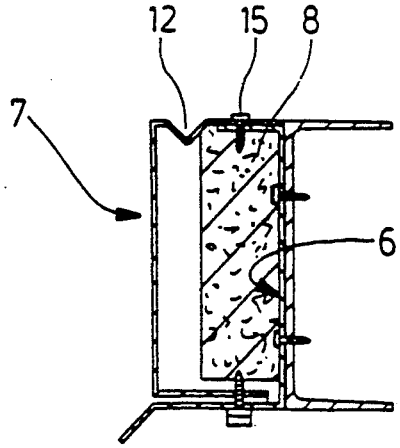
FIG. 8 is a side cross-section of a typical installation illustrating the relative position of the inner and outer panels, the thermal insulation placed between them, fastening points, and the spacers.

FIG. 6 shows that placed along the bottom surface of the lower horizontal section 7*c* of the outer panel 7, and spaced approximately every twelve to eighteen inches, are weep slots 33 and hat style spacers 34. An enlarged detail of a single weep slot and hat spacer is shown in FIG. 7.

A variant of the described two panel system is a system comprising one continuous panel that would essentially replace the combined inner and outer panels 6 and 7. This one panel system would also be a face mount self-draining system incorporating a drainage groove or channel 12, internal thermal insulation 8, and some form of weep slots 33 and drip edge 11. The method likely for fastening this system would comprise of a hanger or strap system again designed so as to prevent any outside temperatures from being conveyed into the interior of the building structure.

The invention is designed to operate as a self-draining system. Once the exterior weather sealant 17 breaks down, water that penetrates will flow into the drainage groove 12 located in the top of the outer panel 6. The water will then flow through the drainage holes 13 to the lower horizontal section *7c* of the outer panel 7 where it can drain through the weep slots 33 and out of the system and away from the building via the inner panel 6 and drip edge 11.

The drip edge 11 also acts as a physical barrier to ultraviolet radiation and as such reduces exposure of the exterior weather sealant 17*b* to same, thus prolonging the sealant's longevity.

Figure 4:
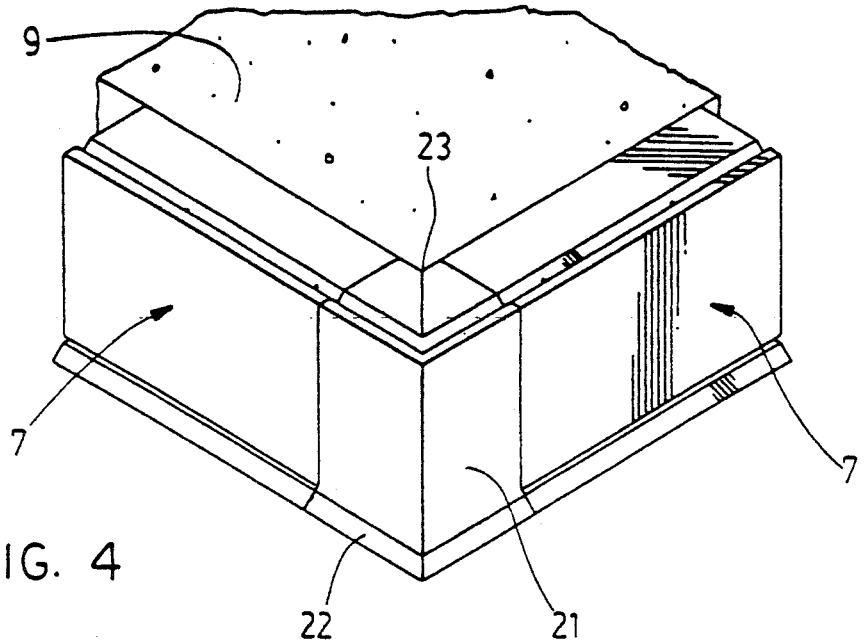
FIG. 4 is top perspective view of an installation showing an outside corner treatment.
Figure 5:
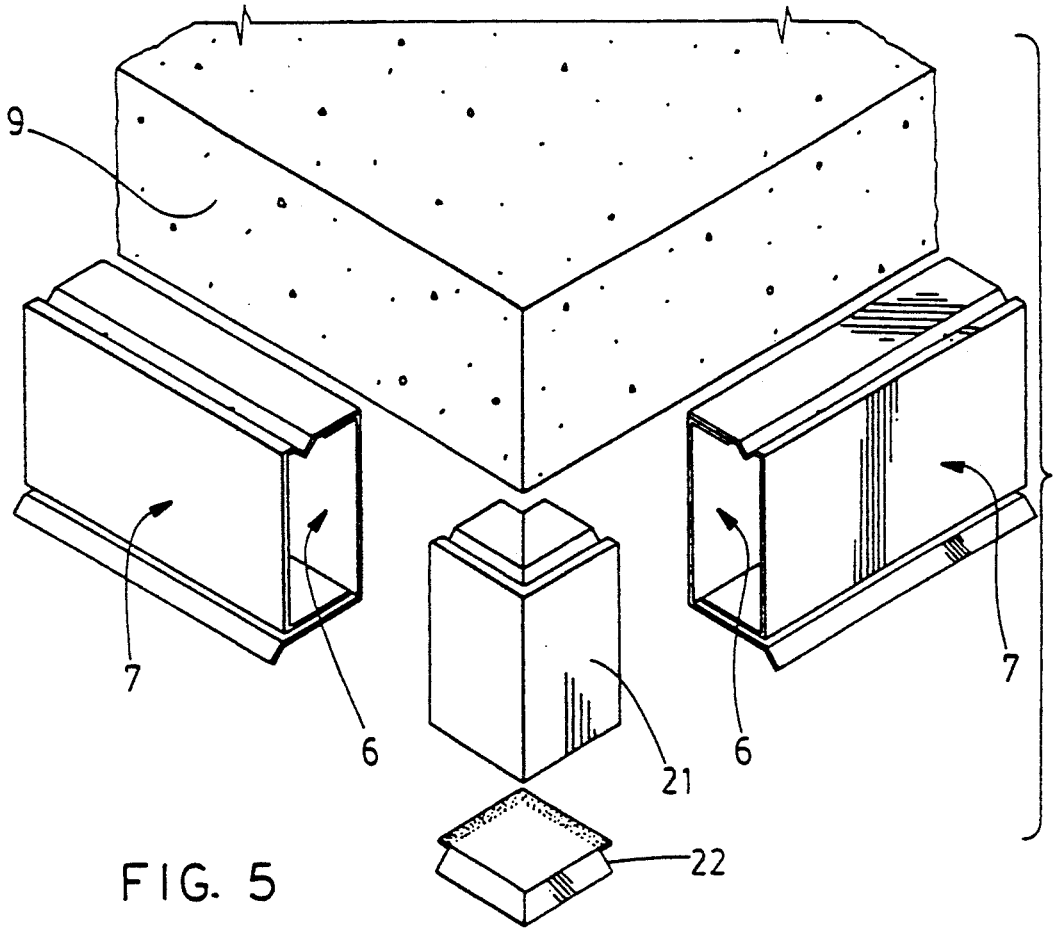
FIG. 5 is an exploded perspective view corresponding to FIG. 4.

FIGS. 4 and 5 show the system components for the treatment of an outside corner. The inner panels 6 are fastened to the slab or slab and wall 9 so that the edges of the two inner panels abut at the corner 23. The outer panels 7 then are secured in the normal manner with mechanical fasteners. A one-piece corner section 21 is then installed so that it rests on top of and overlaps the outer panels, which overlap provides a weather-resistant seal. The overlap also acts to physically hold the corner piece in place. The bottom cover 22 for the corner panel 21 is then secured using a suitable adhesive and fasteners and finally all exposed joints between the components of the corner system are sealed with a weather-resistant sealant.

Figure 9:
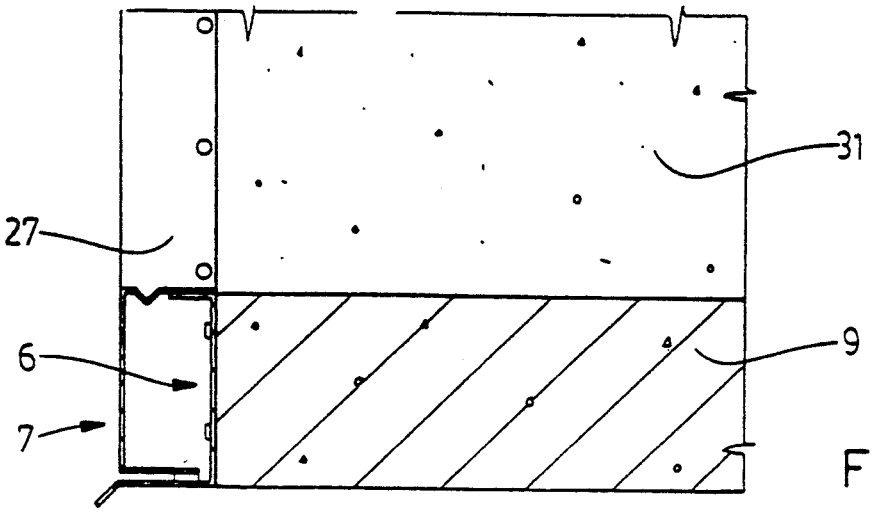
FIG. 9 is side cross-section of a column treatment illustrating the relation of the panels in the vertical plane.
Figure 10:
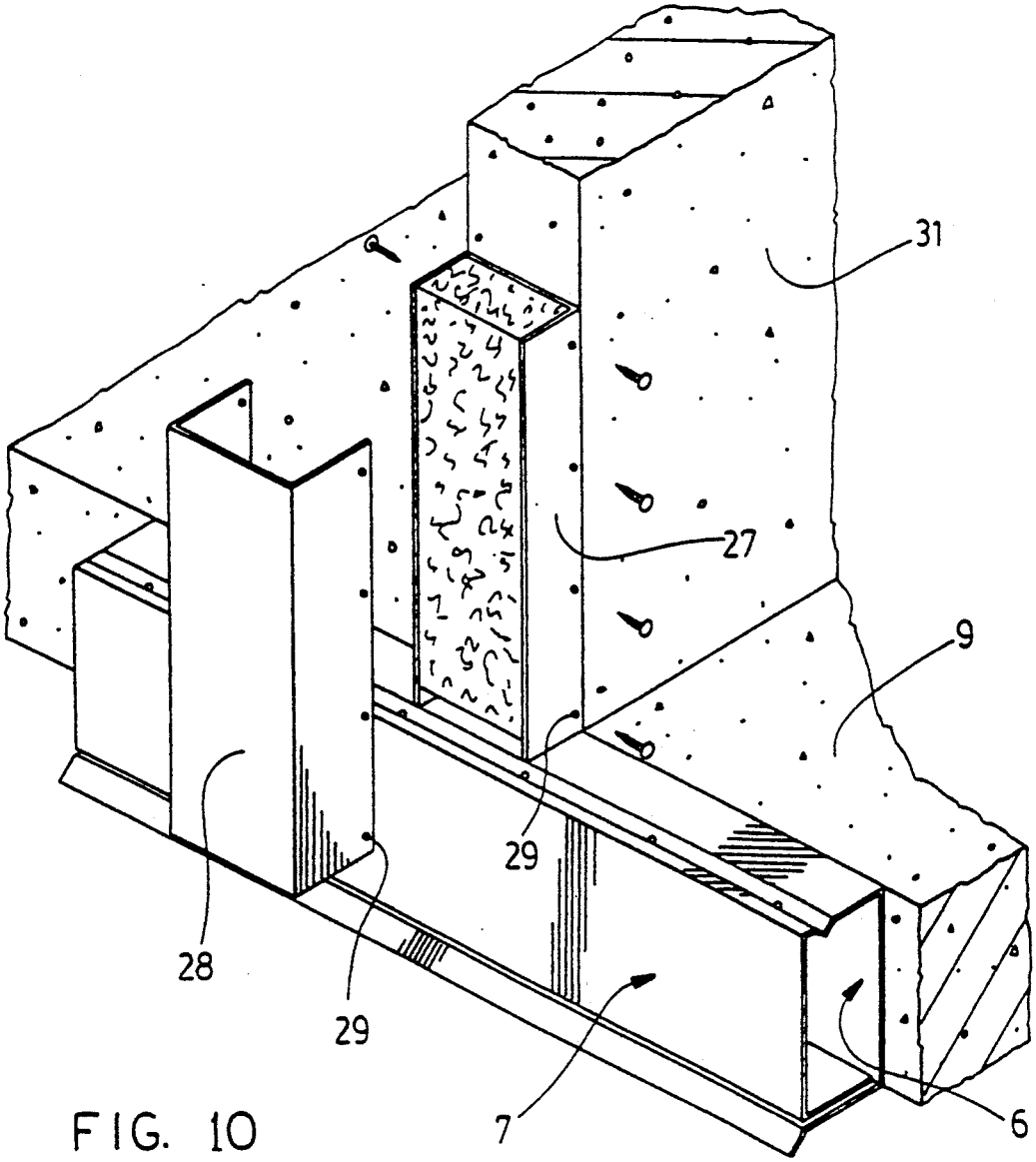
FIG. 10 is an exploded perspective of the panel system as installed over a vertical column on the exterior of a building.

FIGS. 9 and 10 show the treatment of a vertical building column. The inner panel 24 is first secured to the slab 26 in the usual manner. The outer panel 25 is then secured to the inner panel. An inner column panel 27 is then secured to the face of the column using mechanical fasteners, again typically being explosive actuated pins or tapcon screws. An outer column panel 28 is then placed over the inner column panel and secured at 29 using mechanical fasteners such as corrosion-resistant self-tapping screws. The outer column panel is fabricated to be of slightly greater width than the inner column panel to fit around the inner column panel. FIG. 9 shows a cross section of a column treatment illustrating the relation of the panels in the vertical plane.

Figure 11:
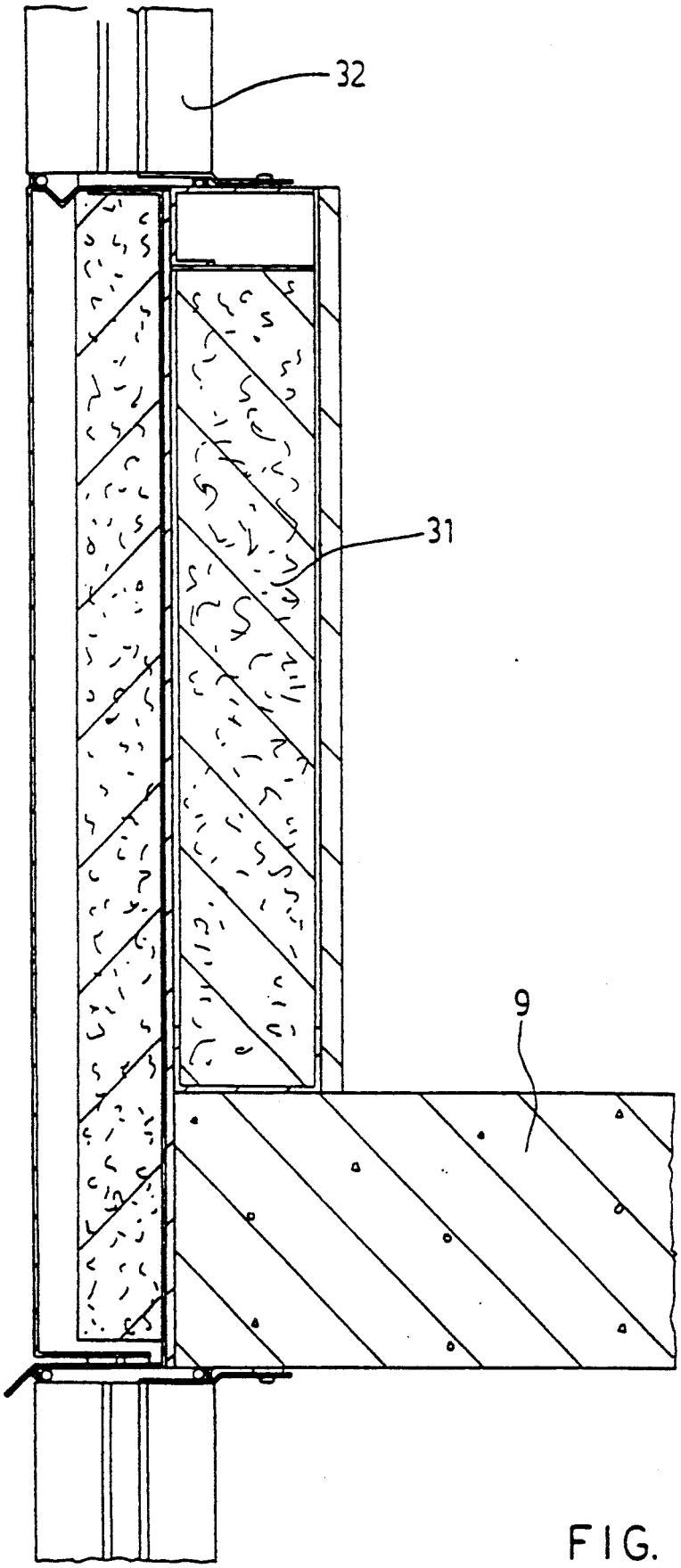
FIG. 11 is a side elevational section as taken at line 11—11 of FIG. 1 illustrating the panel system covering the end of a flooring slab and continuing upwards to cover the lower portion of the exterior wall.

FIG. 11 shows a panel system covering the end of a flooring slab 30 as well as the wall 31 between the window 32 and the flooring slab. This application is identical to the application covering only the end of a flooring slab 9 as shown in FIG. 2, with the exception that the size of the inner and outer panels 6 and 7 is greater so as to also cover the face of the wall area 31.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed is:

1. A building panel for installation on the vertical face of a building adjacent another building element, said panel comprising: a vertical face portion and integral upper and lower horizontal portions, together defining a U-shape, sealing means between said upper portion and said other building element at a seal location near said face portion, with said face portion disposed in a vertical plane and spaced from the face of the building with said upper and lower and lower portions directed towards the face of the building, said upper portion having a downwardly-directed channel defined therein and running generally parallel to said face panel behind said seal location, said channel having at least one drain hole in the bottom thereof, whereby moisture getting past said seal location collects in said channel and drops through said at least one drain hole onto said lower portion, said lower portion having drain means for draining said moisture therefrom.

2. A building panel system, comprising a building panel as recited in claim 1 and a complementary U-shaped positioning element having a vertical mounting surface and integral upper and lower horizontal positioning, surfaces, said mounting surface being adapted for fastening to said vertical face of the building with said upper and lower positioning surfaces projecting outwardly therefrom, said upper and lower positioning surfaces being adapted for fastening of said upper and lower portions respectively of said building panel thereto.

3. A building panel system as recited in claim 2, further comprising spacing means for spacing said lower portion of said building panel slightly above said lower positioning surface of said positioning element.

4. A building panel system as recited in claim 3, in which said drain means drains from said lower portion of said building panel onto said lower positioning surface.

5. A building panel system as recited in claim 4, in which said spacing means comprises a plurality of drains projecting downwardly from said lower portions of said building panel.

6. A building panel system as recited in claim 4, in which said lower positioning surface has an integral downwardly angled drip edge projecting outwardly beyond the plane of said face portion for draining moisture from said lower positioning surface and away from said building.

7. A building panel system as recited in claim 5, in which said lower positioning surface has an integral downwardly angled drip edge projecting outwardly beyond the plane of said face portion for draining moisture from said lower positioning surface and away from said building.

* * * * *